United States Patent [19]

Bernard

[11] Patent Number: 4,809,478

[45] Date of Patent: Mar. 7, 1989

[54] FOAM WALL AND CEILING HOLE REPAIR METHOD

[76] Inventor: Andre Bernard, 5 Kitchel Rd., Mt. Kisco, N.Y. 10549

[21] Appl. No.: 122,036

[22] Filed: Nov. 17, 1987

[51] Int. Cl.[4] ..... E04G 23/02

[52] U.S. Cl. ..... 52/514; 52/743; 52/309.4

[58] Field of Search ..... 52/514, 743, 741, 309.8, 52/309.5, 309.4

[56] References Cited

U.S. PATENT DOCUMENTS

| | | | |
|---|---|---|---|
| 3,289,374 | 12/1966 | Metz | 52/514 |
| 3,295,285 | 1/1967 | Metz | 52/514 |
| 3,380,213 | 4/1968 | Hartman et al. | 52/309.5 |
| 3,583,122 | 6/1971 | Biegajski | 52/514 |
| 4,075,809 | 2/1976 | Sirkin | 52/514 |
| 4,100,712 | 7/1978 | Hyman | 52/514 |
| 4,715,151 | 12/1987 | Garblik | 52/514 |

FOREIGN PATENT DOCUMENTS

| | | | |
|---|---|---|---|
| 135926 | 6/1979 | Fed. Rep. of Germany | 52/309.5 |
| 2277958 | 2/1976 | France | 52/514 |

*Primary Examiner*—David A. Scherbel
*Assistant Examiner*—Caroline D. Dennison
*Attorney, Agent, or Firm*—Myron Amer

[57] ABSTRACT

A wall or ceiling hole repair method using plastic foam in which the foam, while expanding, is confined to the hole requiring repair so that it expands into gripping contact with the edges bounding the hole, and thus in effect wedges itself in place.

3 Claims, 2 Drawing Sheets

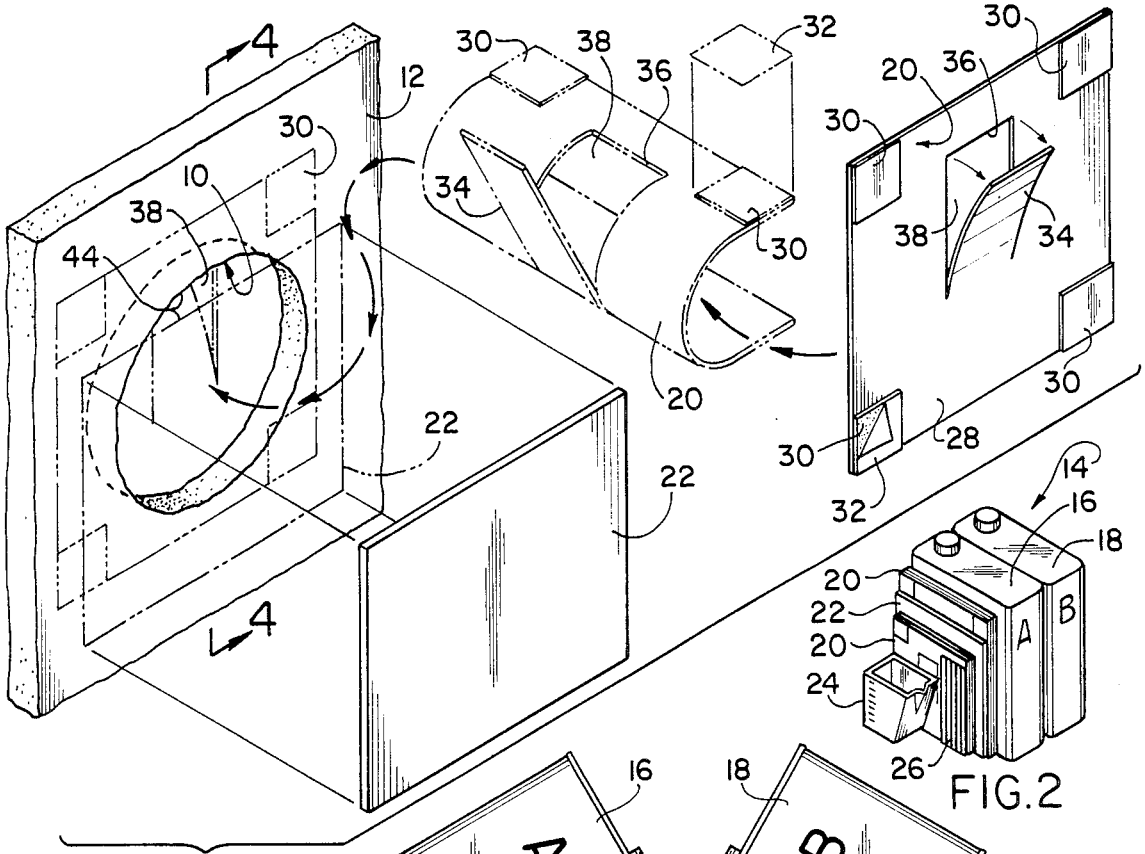
FIG.1
FIG.2
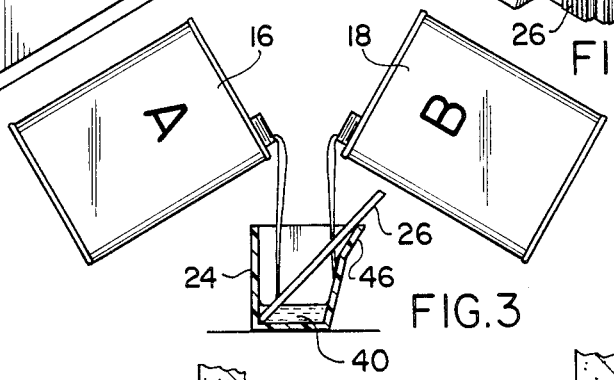
FIG.3
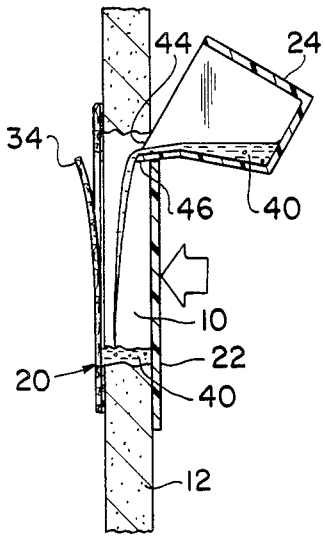
FIG.4A
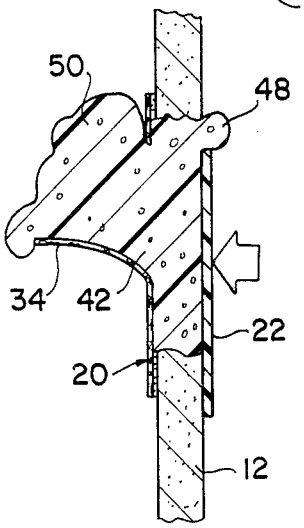
FIG.4B
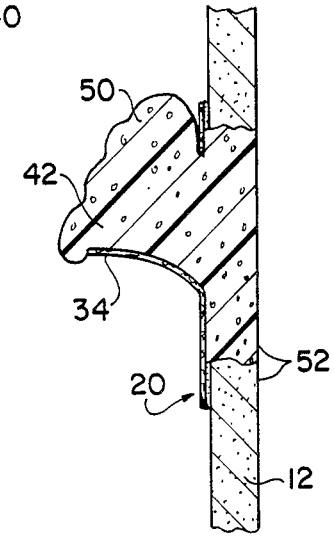
FIG.4C

FOAM WALL AND CEILING HOLE REPAIR METHOD

The present invention relates generally to repairing holes in sheetrock walls and ceilings.

PRIOR ART

Quite often during the redecorating or renovation of a building, it is necessary to repair a large hole in a sheetrock wall or ceiling. A prior technique was to use crumpled newspaper as backing and apply several coats of spackling putty, which usually dried in a shrunken condition. Cracks and hollows necessitated additional time consuming coats of spackle. In the case of ceilings, often there is nothing but attic space above the sheetrock, which makes it necessary to piece the sheetrock; a costly and time consuming process, seldom done exactly right.

EXAMPLES OF PRIOR ART

U.S. Pat. No. 4,285,183 issued on Aug. 25, 1981 to CONDIT accurately explains the difficulty in patching a hole in wallboard or sheetrock wherein the hole is somewhat enlarged in its rear portion and there is no access to the rear of the hole. It is noted more particularly that any attempt to insert plaster or similar patching substance within the hole results in that substance merely falling into the enlarged rear portion of the opening. The solution of CONDIT is to provide means for adhesively securing, from the front of the hole, a so-called base 12 for the hole, and then, with said base in place, filling the hole forwardly of the base with a patching plaster or the like. It is clear therefore that the plaster recommended for use by CONDIT merely fills the hole, but does not engage the periphery or wallboard edges which bound the hole to contribute to holding itself in place.

U.S Pat. No. 4,354,332 issued on Oct. 19, 1982 to LENTZ is, like CONDIT, also related to the patching of wallboard openings and provides in locations where there is no stud but merely space behind the hole, and thus potentially weak structure for holding the patch in place, an improved backup or backing over the back of the hole. LENTZ also follows the prior art of using spackling compound, patching plaster or other patching material which is trowelled into the hole.

U.S. Pat. No. 3,380,213 issued on Apr. 30, 1968 to HARTMAN ET AL. is not related to patching holes in wallboard, but must be noted because it discloses the use of foam to fill holes in plywood, such as knotholes, voids, splits, etc., to upgrade the plywood. Using a polyurethane foam for example, HARTMAN explains that as it foams it readily fills in the irregular voids, etc., and has excellent "adhesion" to the wood fibers and will not become loose or detached. Moreover, the manner of use proposed by HARTMAN is to place a non-foamed, but foamable polyurethane material in the void defect, and then placing the plywood containing same under pressure and subjecting it to an elevated temperature, such as 250° F. plus.

Thus, even apart from the fact that HARTMAN is not using the foam to patch a wallboard hole while the wallboard is part of a structure, the teaching of this patentee is that the foam is held in place by its "adhesion" to wood fibers, and thus a teaching which overlooks the more significant fact that in expanding, the foam presses itself firmly against the wallboard edges bounding the hole, and thus firmly holds itself in place within the hole.

The present invention allows for quick and economical repair of sheetrock walls and ceilings by utilizing on site mixing of polyurethane foam plastic and a few simple tools all of which can be procured in kit form or improvised. Even more significant, and as noted above, the repair material is, in effect, wedged in the hole, rather than merely adhesively attached to the edges bounding the hole, and thus is not readily dislodged from its position in the hole.

The description of the invention which follows, together with the accompanying drawings should not be construed as limiting the invention to the example shown and described, because those skilled in the art to which this invention appertains will be able to devise other forms within the ambit of the appended claims.

FIG. 1 a perspective view of a damaged wall and includes a schematic showing of the placement thereon of hole-patching components according to the present invention;

FIG. 2 is a perspective view of the components recommended to be supplied in one form of a wall patching kit;

FIG. 3 is a view of the mixing technique required to prepare the polyurethane foam component;

Figure 5:
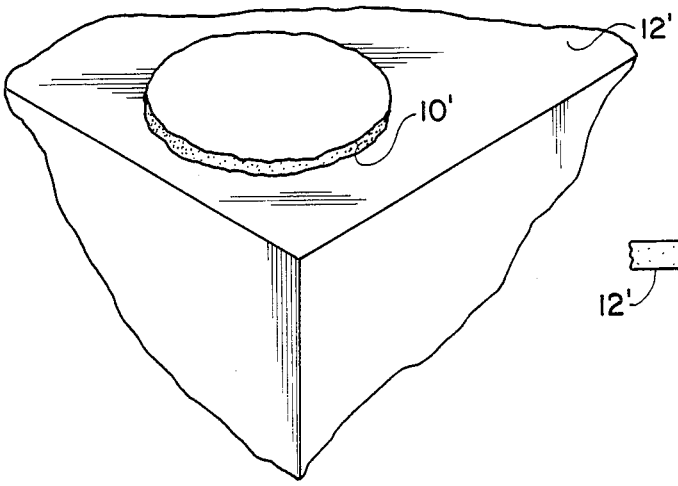
Figure 6:
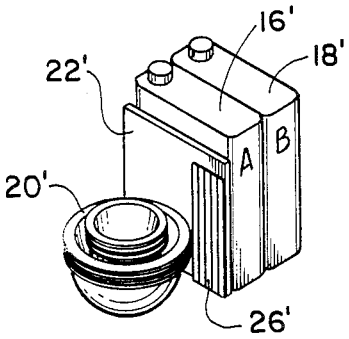

FIGS. 4 A-C is a series of sectional views as seen along line 4—4 of FIG. 1;

FIG. 5 is a view of a damaged ceiling to be repaired with the hole-patching components of the present invention;

FIG. 6 is a perspective view of the components similarly recommended to be supplied in one form of a ceiling patching kit; and FIGS. 7 A-E is a series of sectional views illustrating the application of a ceiling patch according to the present invention.

Preliminary to the detailed explanation of the inventive procedure for making patch repairs to sheetrock walls and ceilings, a material used in both applications will be described. Expandable liquid polyurethane foam has found use in an ever increasing number of industries. In most applications, equal amounts of two fluid components are poured into a container and thoroughly mixed. Measured quantities used are based on the volume of the void to be filled and a knowledge that the finished rigid foam has a volume approximately twenty-five times that of the component fluid mixture. After the components, usually referred to as fluid A and fluid B, are mixed, a reaction results in rapid formation of bubbles which expand to a rigid foam plastic, which takes the shape of its container.

A more detailed and comprehensive description and explanation of how fluids A and B, as above generally described, produce a rigid plastic foam is set forth in U.S. Pat. No. 3,380,213 issued on Apr. 30, 1968 to HARTMAN ET AL., and is incorporated herein by reference. What constitutes the present invention is not the fluids A and B, but how these fluids are used in making repairs to holes in sheetrock walls and ceilings, as will now be described in detail.

In FIG. 1 is shown a hole 10 of random shape in sheetrock wall 12 in need of repair. To repair hole 10 a kit 14 (FIG. 2) is procured which contains the two fluid components of polyurethane foam-producing fluids previously referred to as A and B and respectively identified as 16 and 18, plus an assortment of large and small backing cards 20, a filling plate 22, a graduated beaker 24 and mixing sticks 26. Suitable packaging is not shown. Fluid containers for components A and B can be conventional screw top cans or tubes to suit.

Backing card 20 is shown in solid line as part of FIG. 1 and consists of an appropriate sized cardboard rectangle 28 with four corner adhesive tabs 30 thereon. Each tab 30 has a protective paper cover 32 which is removed immediately prior to installation as shown in the two dot phantom view in the middle of FIG. 1. To install card 20, it is necessary to bend the card almost in half to fit it through hole 10, where it is allowed to flatten so adhesive tabs 30 can then be adhered to the interior surface of sheetrock 20. To facilitate handling of card 20, a flap 34 is made by a three sided cut 36. Additionally, opening 38 can be used as a finger passage for pressing tabs 30 firmly in place after card 20 is positioned on the interior surface of sheetrock 12. Card 20 is shown in final position relative to hole 10 by the three dot outline in FIG. 1. Also shown in FIG. 1 is the fill plate 22 which will be explained shortly.

At this point, it will be understood that hole 10 has been prepared for repair and an estimate of its volume is required. In FIG. 3 is shown the foam components being poured into beaker 24. Enough of each foam component A and B should be used to make approximately twice the volume of hole 10. Mix 40 is then stirred thoroughly with stick 26 whereupon slight foaming should begin. At this point fill plate 22, a smooth flat rectangle of rigid plastic, is hand held in place as shown in the two dot outline of FIG. 1. A segment 44 of hole 10 is left uncovered so that pouring spout 46 can be inserted over the edge of fill plate 22 in order to empty the contents of beaker 24 within the void of hole 10 as seen in FIG. 4A. If time and technique permit, fill plate 22 can be raised to cover segment 44 to prevent foam blob 48 from forming (FIG. 4B). As mix 40 transforms into a foam mass 42, flap 34 now serves as a vent for excess material 50.

FIG. 4C shows the finished repair where plate 22 has been removed and surface 52 has been sanded smooth, thereby removing excess 48 if present.

In FIG. 5 is shown a random irregular hole 10′ in a sheetrock ceiling 12′ which has been rounded out to take advantage of the use of polyurethane foam in turn using a round bowl. To repair hole 10′, a ceiling repair kit 14′ as shown in FIG. 6 is procured. Kit 14′ contains foam components A and B (respectively 16′ and 18′), an assortment of small and large expendable mixing bowls 20′, a support plate 22′, and mixing sticks 26′.

Figure 7E:
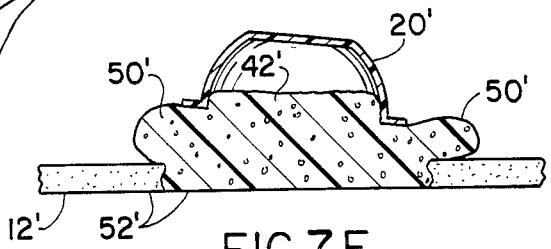
Figure 7D:
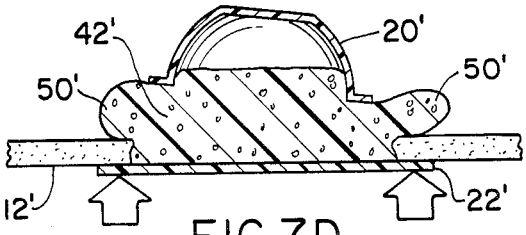

The ceiling hole 10′ of FIG. 5 has been dressed, if need be, to be slightly larger than flange 54 of bowl 20′. In FIG. 7A equal amounts of foam components A and B (16′ and 18′) are poured into bowl 20′ and mixed with stick 26′. As before, quantities of A and B are estimated to be at least enough to fill twice the volume of hole 10′. Before setting aside stick 26′, a small quantity of mix 40′ is dabbed around the upper surface of flange 54 to make a "wet" seal to engage plate 22′ when it is placed thereon as shown in FIG. 7B without permitting leakage under the bowl 20′ when it is inverted.

Figure 7C:
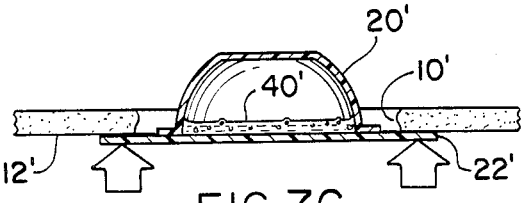
Figure 7A:
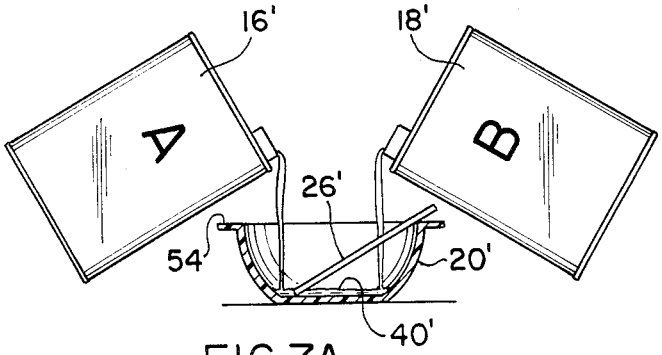
Figure 7B:
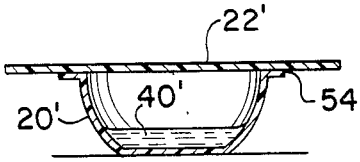

As mix 40′ begins to foam, bowl 20′ and plate 22′ are inverted and located as shown in FIG. 7C within hole 10′. Plate 22′ is held firmly in place as mix 40′ transforms to rigid foam mass 42′ lifting bowl 20′ and allowing excess material 50′ to extend above and beyond hole 10′ where it rests on sheetrock 12′ (FIG. 7D).

Upon solidification of foam 42′, support plate 22′ is removed and surface 52′ is sanded smooth as shown in FIG. 7E.

Underlying the present invention is the recognition that in both vertical wall and horizontal ceiling hole repairs, that the expanding foam 42, 42′ expands outwardly against the edges bounding the hole, and thus is held in place within the hole, with little or no reliance upon any adhesive attachment of the foam to the sheetrock material. This "wedging" of the foam in the hole being repaired has been found in practice to produce a stronger repair than can be obtained using spackling putty or any similar prior art material which functions by adhesively securing itself to the hole edges.

While the particular sheetrock repair materials and method herein shown and disclosed in detail is fully capable of attaining the objects and providing the advantages hereinbefore stated, it is to be understood that it is merely illustrative of the presently preferred embodiments of the invention and that no limitations are intended to the detail of construction or design herein shown other than as defined in the appended claims.

What is claimed is:

1. A method of repairing holes in sheetrock walls using plastic foam resulting from the admixture of two fluid chemicals, said method comprising the steps of adhering a rear closure member having integral mounting means over the back of the hole requiring repair, placing a front closure member partially over the front of the hole requiring repair so as to define a foam-receiving compartment between said front and rear closure members that is additionally bounded by the edges that in turn bound said hole and having an inlet opening thereinto in the clearance left by said front closure member being only partially over said front of said hole, admixing said two fluid chemicals and pouring same through said inlet opening into said foam-receiving compartment, restraining the foam resulting from said admixture to said foam-receiving compartment, whereby said restrained foam is forced to expand into gripping contact with the edges bounding the hole requiring repair and thereby hold itself in place therein, and removing said front closure member from the hole.

2. The method of repairing holes in sheetrock walls using plastic foam as claimed in claim 1, wherein said rear closure member is placed in a clearance position over the back of the hole requiring repair, and including the step of permitting any excess foam to expand in said clearance between said rear closure member and said sheetrock wall.

3. A method of repairing a hole in a ceiling using plastic foam resulting from the admixture of two fluid chemicals, said method comprising the steps of establishing the size of said hole requiring repair, admixing said two fluid chemicals in a bowl-like container of a size selected to be smaller than said established size of said hole requiring repair, covering said container and inverting same, projecting said covered inverted container with said admixed chemicals upwardly through said hole requiring repair, and restraining under the weight of said inverted container the foam resulting from said admixture to the plane of said hole requiring repair, whereby said restrained foam is forced to expand into gripping contact with the edges bounding the hole requiring repair and thereby hold itself in place therein.

* * * * *